US006644209B2

(12) United States Patent
Cummins

(10) Patent No.: US 6,644,209 B2
(45) Date of Patent: Nov. 11, 2003

(54) ALL-WEATHER GUIDED VEHICLE SYSTEM

(76) Inventor: Richard D. Cummins, 33 Harmony Cir., Orchard Park, NY (US) 14127

( * ) Notice: Subject to any disclaimer, the term of this patent is extended or adjusted under 35 U.S.C. 154(b) by 18 days.

(21) Appl. No.: 10/330,833

(22) Filed: Dec. 27, 2002

(65) Prior Publication Data

US 2003/0097954 A1 May 29, 2003

Related U.S. Application Data

(63) Continuation-in-part of application No. 10/013,037, filed on Oct. 30, 2001, which is a continuation-in-part of application No. 09/533,638, filed on Mar. 22, 2000, now abandoned.

(60) Provisional application No. 60/125,985, filed on Mar. 24, 1999.

(51) Int. Cl.[7] ..... B60V 3/04; B61B 13/12

(52) U.S. Cl. ..... 104/156; 104/23.1; 104/140; 104/124

(58) Field of Search ..... 104/124, 125, 104/155, 156, 23.1, 23.2, 140

(56) References Cited

U.S. PATENT DOCUMENTS

| | | | | |
|---|---|---|---|---|
| 3,444,823 A | | 5/1969 | Akmentin | |
| 3,534,689 A | | 10/1970 | Barthalon | |
| 3,722,424 A | | 3/1973 | Van Veldhuizen | |
| 3,785,295 A | * | 1/1974 | Kiukkonen | 104/155 |
| 3,799,061 A | | 3/1974 | Bertin | |
| 3,919,947 A | | 11/1975 | Simon et al. | |
| 3,938,445 A | | 2/1976 | Hughes | |
| 4,085,681 A | | 4/1978 | Barber | |
| 4,102,272 A | | 7/1978 | Lehl et al. | |
| 4,574,705 A | | 3/1986 | von Winckelmann | |
| 5,535,963 A | | 7/1996 | Lehl et al. | |
| 5,566,620 A | | 10/1996 | Siewert | |
| 5,601,026 A | * | 2/1997 | Rothemeyer et al. | 104/155 |
| 6,178,892 B1 | | 1/2001 | Harding | |
| 6,213,026 B1 | | 4/2001 | Coester et al. | |
| 6,267,058 B1 | | 7/2001 | Schlienger | |
| 6,279,485 B1 | | 8/2001 | Schlienger | |
| 6,360,670 B1 | | 3/2002 | Schlienger | |

* cited by examiner

*Primary Examiner*—D. Glenn Dayoan
*Assistant Examiner*—G Blankenship
(74) *Attorney, Agent, or Firm*—Simpson & Simpson, PLLC

(57) ABSTRACT

An all-weather guided vehicle system having a guideway including a single tube or a pair of parallel tubes capable of storing pressurized air. Vehicles are suspended below, above, or beside the tube(s) by way of carriages to which the vehicles are connected. Arcuate roller tracks between the vehicle and the carriage provide a banking mechanism for cornering. The tube(s) support continuous high-speed rails to receive suspension members extending from the carriage for air or wheeled suspension. Impulse vanes are provided on a vertical rod extending through a slotted opening in a propulsion channel for cooperation with air jet nozzles located within the channel to propel and brake the carriage. Embodiments having a fair-weather vehicle riding atop the deck and tire tracks for suspension and prevention of side sway are also disclosed.

38 Claims, 11 Drawing Sheets

ALL-WEATHER GUIDED VEHICLE SYSTEM

CROSS-REFERENCE TO RELATED APPLICATIONS

This continuation-in-part patent application claims benefit under 35 U.S.C. §120 of U.S. patent application Ser. No. 10/013,037, filed on Oct. 30, 2001, and currently co-pending, which application is a continuation-in-part and claimed benefit under 35 U.S.C. §120 of U.S. patent application Ser. No. 09/533,638, filed Mar. 22, 2000, now abandoned, which claims benefit under 35 U.S.C. §119(e) of U.S. Provisional Patent Application Serial No. 60/125,985 filed Mar. 24, 1999.

BACKGROUND OF THE INVENTION

The present invention relates generally to guided vehicle systems, and more particularly to an all-weather guided vehicle system for high-speed travel between metropolitan hubs.

High speed "trains" or guided vehicle systems for passenger travel must operate without delays due to precipitation, snow, ice, and accompanying poor visibility, since such delays affect connecting ground and air transportation. Moreover, eliminating weather delays is an important safety consideration because the location and speed of every vehicle in the system is controlled both centrally and on-board each vehicle. Accordingly, protection of suspension and propulsion mechanisms of the guided vehicle system from the elements is of primary importance.

SUMMARY OF THE INVENTION

The present invention is, therefore, intended to provide an all-weather guided vehicle system. Protection from the elements is accomplished by enclosing the suspension and/or propulsion means of the vehicle system guideway in separate housings having a narrow continuous slot through an underside of the housing through which vertical rods or thin panels attach the suspension and/or propulsion means to the vehicle carriage. The narrow slots are preferably closed at unused portions of the guideway by automatically operated strip flaps to keep out wind driven snow and the like.

BRIEF DESCRIPTION OF THE DRAWINGS

The nature and mode of operation of the present invention will now be more fully described in the following detailed description of the preferred embodiments taken with the accompanying drawing figure, in which.

DETAILED DESCRIPTION OF THE INVENTION

Figure 1:
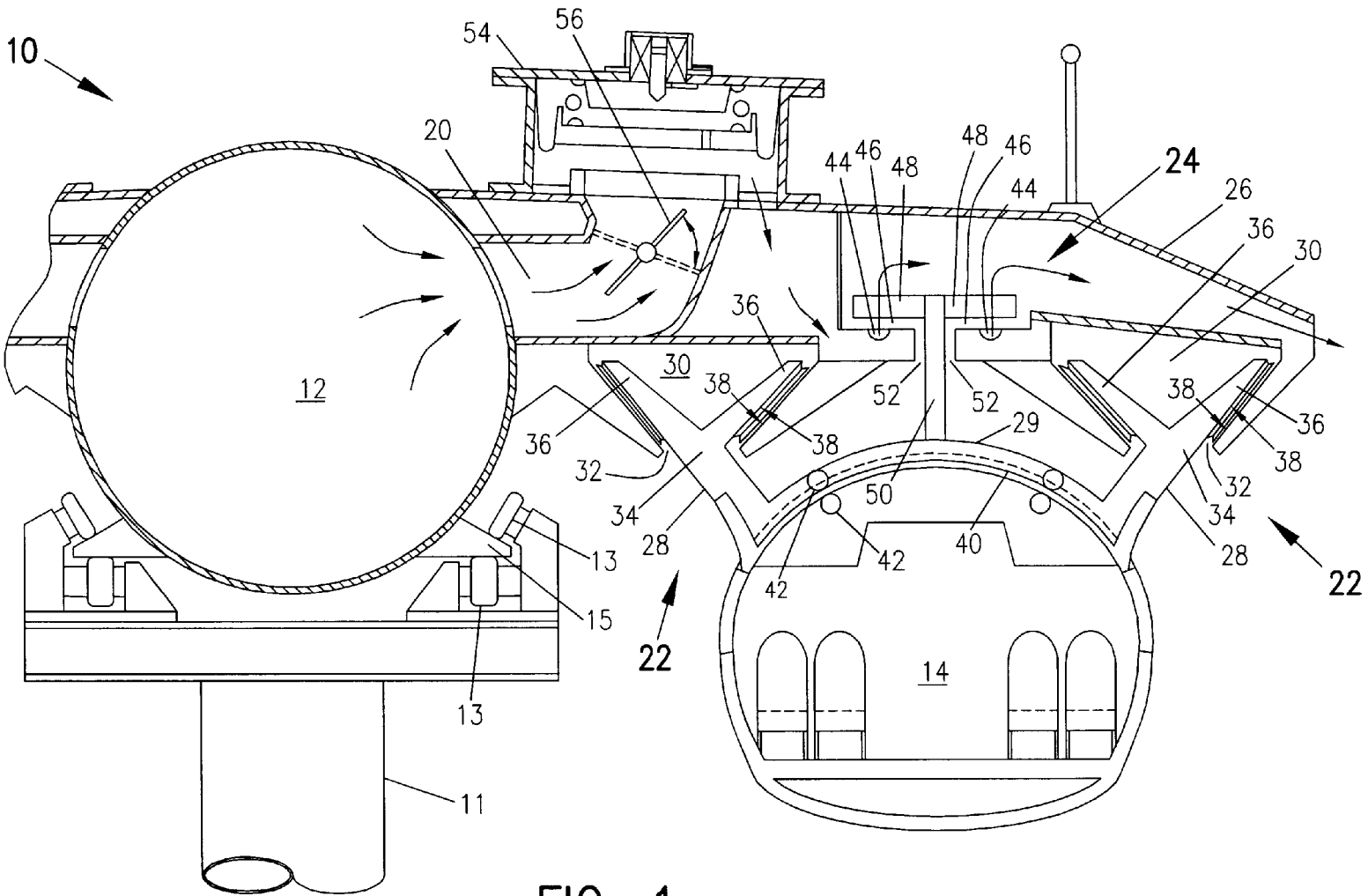
FIG. 1 is a lateral cross-sectional view of an all-weather guideway and vehicle formed in accordance with a first embodiment of the present invention.

Referring now to FIG. 1, a guided vehicle system according to a first embodiment of the present invention is shown and identified generally by the reference numeral 10. Vehicle system 10 includes an elongated tubular guideway 12 for storing and delivering pressurized air to suspension and/or propulsion means of the vehicle system. The guideway is supported above the ground by a series of support columns 11 spaced along the guideway and having support rollers 13 for engaging horizontally extending side tracks 15 on guideway 12 for allowing axially directed thermal expansion of the guideway. A plurality of vehicles 14 are designed for travel along both lateral sides of guideway 12, only one side being shown and described since the opposite side is a mirror image thereof.

A plurality of cantilevered beams 20 extend laterally from guideway 12 and serve to support vehicles 14, shown in the embodiment of FIG. 1 as being suspended from beams 20 by suspension means 22 and propelled along guideway 12 by propulsion means 24. Beams 20 preferably support a continuous deck 26 for shielding vehicle 14, suspension means 22, and propulsion means 24 from rain, ice and snow. As will be understood, beams 20 follow the thermal expansion of guideway 12 to which they are connected.

Suspension means 22 in the first embodiment comprises a pair of Y-shaped suspension members 28 extending upwardly from a carriage 29 for receipt within angular suspension channels 30 supported by beams 20, each angular suspension channel having a slot opening 32 extending the length thereof to accommodate a stem portion 34 of a Y-shaped suspension member 28. The legs 36 of each Y-shaped member oppose corresponding inner surfaces 38 of associated angular channel 30, and are separated slightly therefrom by a cushion of pressurized air or magnetic bearings to substantially eliminate surface-to-surface friction. Where a cushion of pressurized air is used, guideway 12 serves as an air reservoir for supplying lifting air. Carriage 29 with Y-shaped suspension members 28 is connected to vehicle 14 by an arcuate flanged track 40 extending along the carriage between suspension members 28 and arranged for engagement by a plurality of upper and lower roller wheels 42 spring-mounted on vehicle 14 in an arcuate configuration corresponding to that of track 40. In the alternative, roller wheels 42 could be mounted on carriage 29, and track 40 could be provided on vehicle 14. As will be appreciated, vehicle 14 rolls without swinging to achieve desired rotation about the center of curvature of track 40, which is located within vehicle 14 rather than over or under the vehicle. Also, the problem of crosswind torque about an external pivot point is eliminated. The overall height and crosswind profile of vehicle 14 is reduced because of the shared curvatures of the vehicle and carriage 29 without the need for "tilting space".

Propulsion means 24 preferably comprises a plurality of directionally biased nozzles 44 set within a substantially enclosed propulsion channel 46 supported by beams 20 underneath deck 26. A series of directionally biased vanes 48 are connected to carriage 29 by vertical rods 50 which fit though a slot opening 52 in the underside of propulsion channel 46. Air jets issuing from nozzles 44 impinge upon vanes 48 to propel carriage 29 and connected vehicle 14 along guideway 12, and also to brake the carriage and vehicle. Nozzles 44 are in communication with the interior of guideway 12 by way of a pilot-operated thruster valve 54 for supplying propulsion air to the nozzles, and an emergency/maintenance shut-off valve 56 is also provided.

Figure 2:
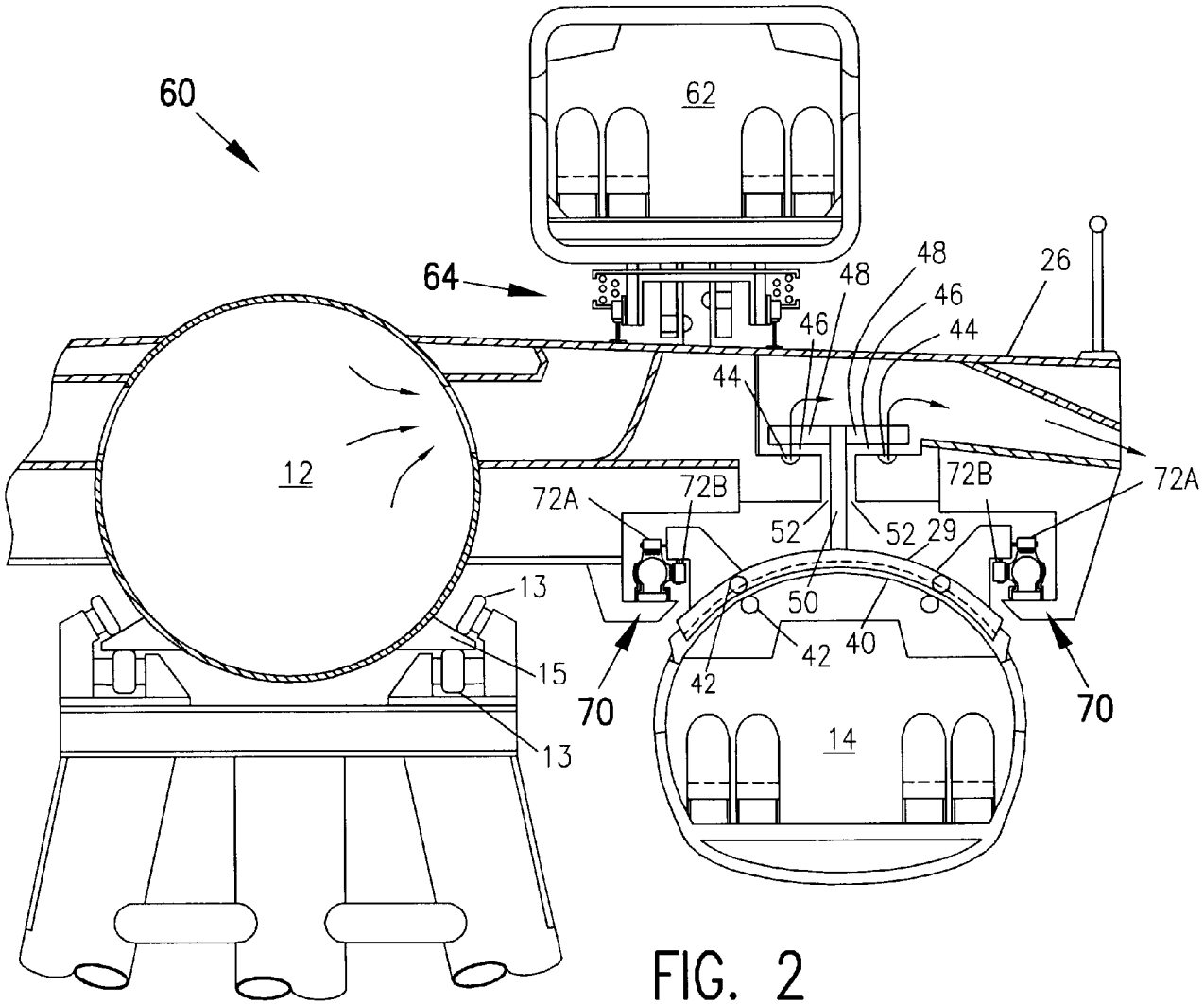
FIG. 2 is a lateral cross-sectional view of an all-weather guideway and vehicle formed in accordance with a second embodiment of the present invention.

A guided vehicle system according to a second embodiment of the present invention is shown in FIG. 2 and designated generally by reference numeral 60. The second embodiment 60 is similar to the first embodiment 10, except that it includes a plurality of topside fair-weather vehicles 62 mounted for travel above deck 26. A dedicated air propulsion and braking system 64 supplied with air stored within guideway 12 is provided for fair-weather vehicles 62, which may be air-levitated or magnetically levitated.

Figure 3A:
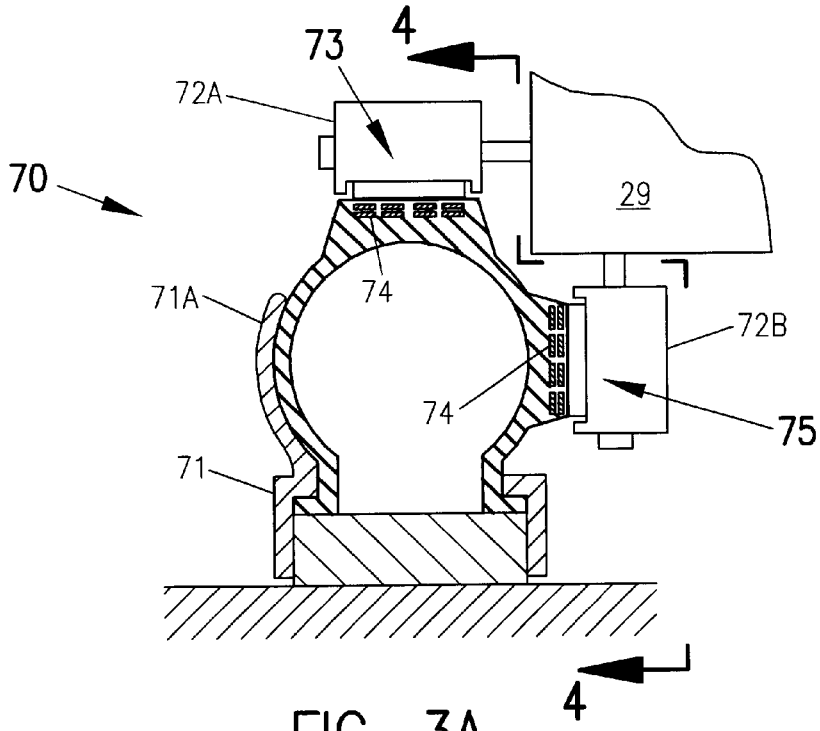
FIG. 3A is a detailed sectional view of a tire track assembly shown in FIG. 2.
Figure 4:
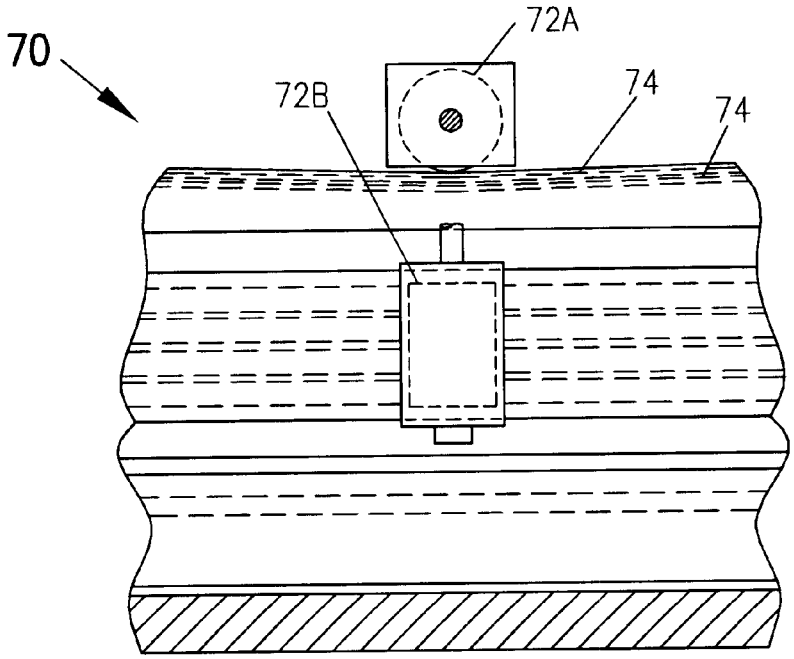
FIG. 4 is a side schematic view of the tire track assembly shown in FIG. 3A.

Another difference appearing in the second embodiment of FIG. 2 is the use of a high-speed "tire track" rails 70 and wheels 72A, 72B for suspension and alignment of carriage 29. Each tire track 70 resembles an automobile or truck tire in construction. An enlarged view of tire track 70 and wheels 72A, 72B is presented in FIG. 3A, and a side elevational view of this structure is presented in FIG. 4. As may be seen in FIG. 4, tire track 70 includes a plurality of strip springs 74 mounted within the tread and side wall of the tire track 70 along a top region 73 and a side region 75 thereof, where the tire track is contacted by passing wheels 72A and 72B, respectively. Strip springs 74 spread out the load of the wheel greatly beyond the area of the depression of the wheel 72A or 72B into the surface of tire track 70. Since the load is extended over a much longer area or length of tire track 70, friction, total deflection, and deflection rates are reduced. The "squeeze" zones at the front and rear of the wheel depression are all but eliminated. If the strip springs are stiff enough to spread the wheel load out between the wheels, the number of flexures would be one per vehicle passage as opposed to one per wheel passage. The vertical deflection accelerations may also be reduced by having the wheel heights increase gradually to the front and rear. These features may also permit use of lower tire pressure for tire track 70, and more numerous and smaller wheels 72, without undue increase in friction. Referring again to FIG. 3A, tire track 70 also includes a support frame 71 including an arcuate counterbrace element 71A that rises along the side of the tire track 70 opposite side region 75 to counteract the horizontal forces of the wheels 72B and to help support the tire track.

Figure 3B:
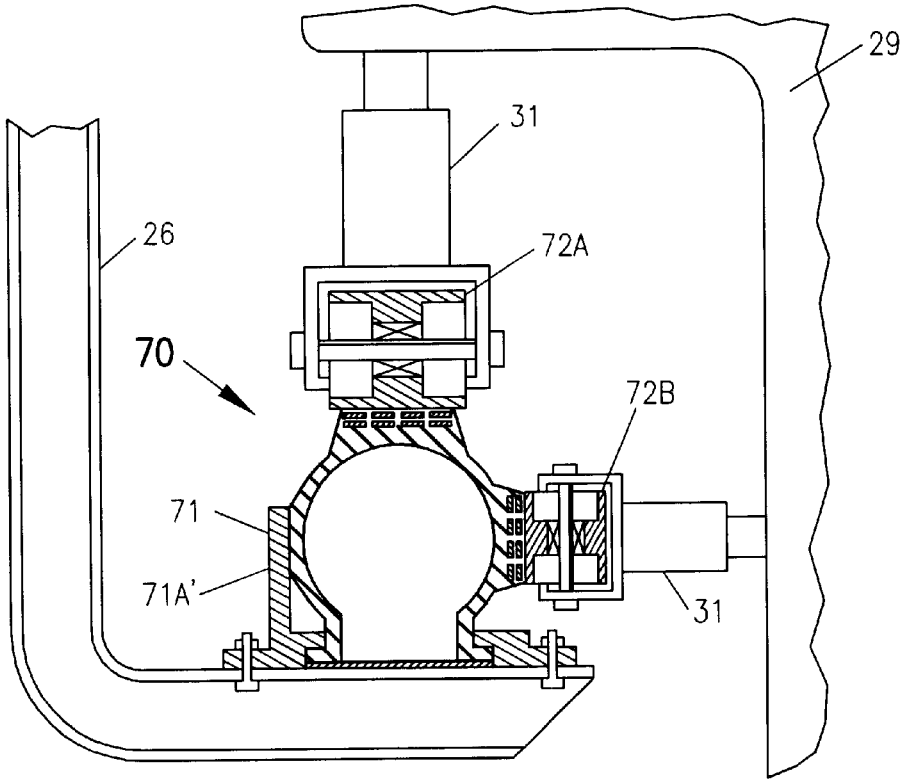
FIG. 3B is a detailed sectional view of an alternative tire track assembly of the present invention.
Figure 3C:
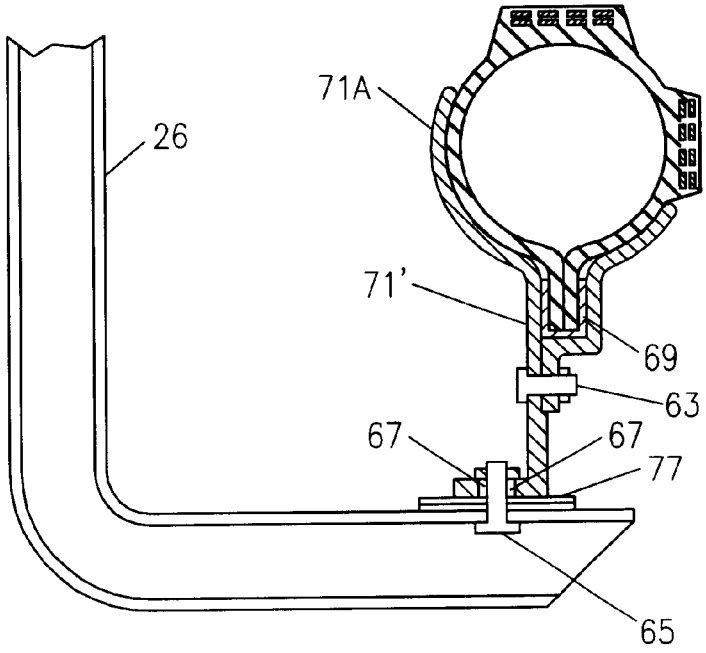
FIG. 3C is a detailed sectional view of an alternative tire track assembly of the present invention.

FIGS. 3B and 3C show alternative tire track arrangements according to the present invention. In FIG. 3B, the counterbrace element 71A' is simply a vertical wall. As can be seen in FIG. 3B, wheels 72A, 72B can be connected to carriage 29 by dampers 31 for dissipating vibration energy for a smoother ride. The tire track variant of FIG. 3C is mounted for lateral and vertical adjustment relative to deck 26 by adjustable fasteners 65 extending through slots 67 formed in bifurcated frame 71' (lateral adjustment) and by shims 77 (vertical adjustment). A serrated crimping channel 69 and clamps 63 function to close and seal the tire track to maintain internal pressure.

Figure 3D:
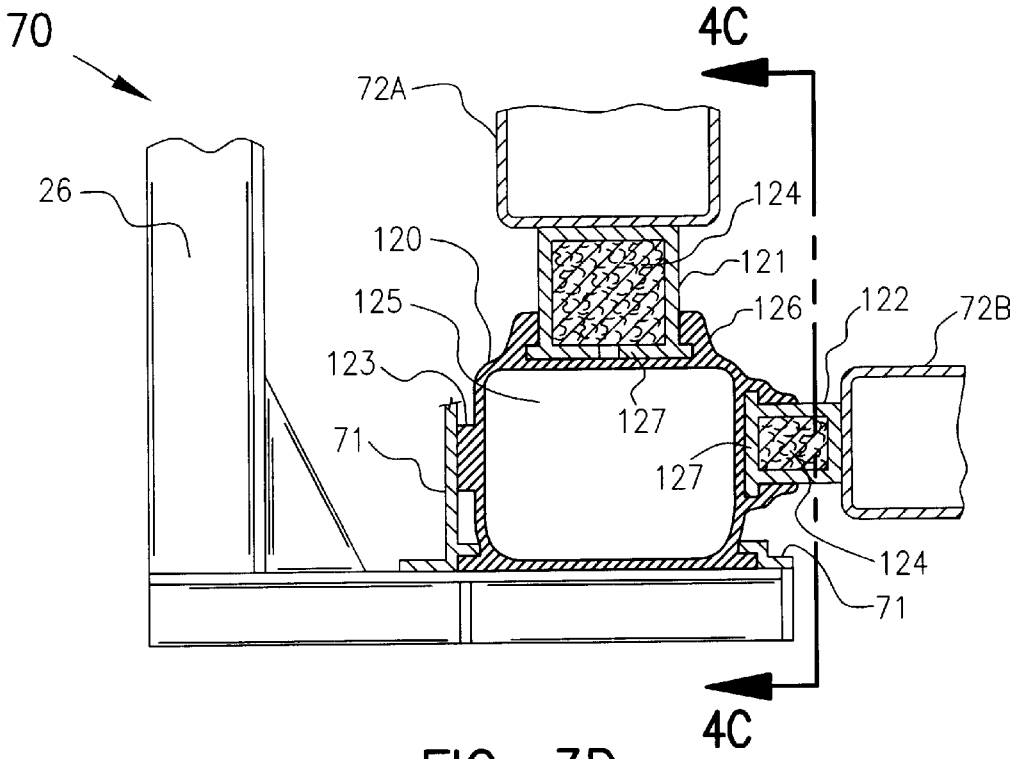
FIG. 3D is a detailed sectional view of an alternative tire track assembly comprising a "tire beam"
Figure 3E:
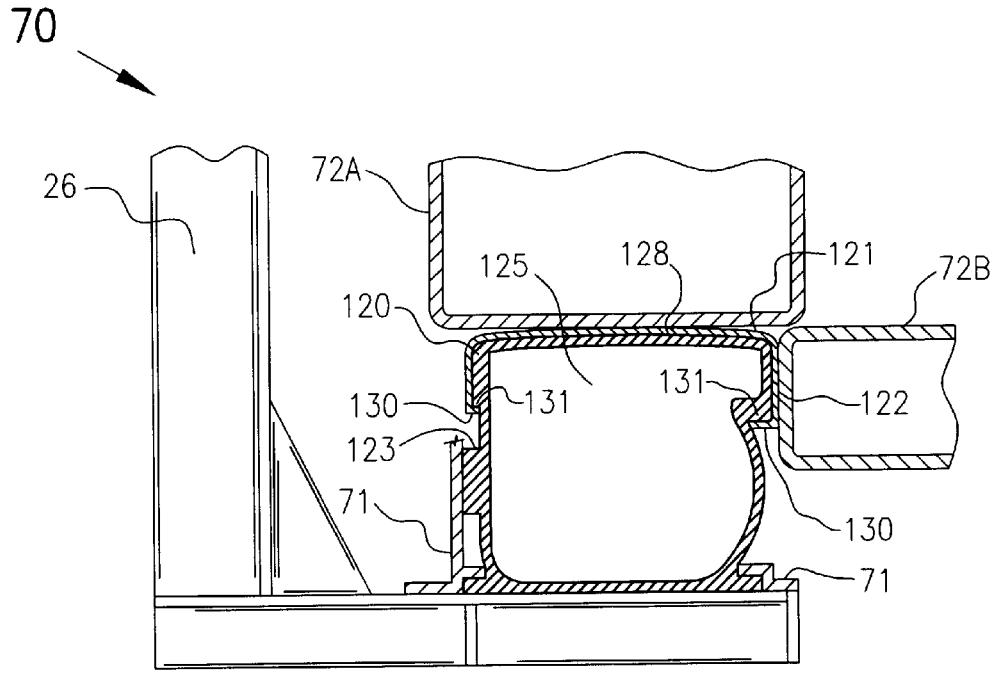
FIG. 3E is a detailed sectional view of another alternative tire track assembly comprising a "tire beam"

Referring now to FIGS. 3*d*–3*e*, the tire track assembly of the present invention may also be configured to comprise tire beams 121 and 122, adapted to more effectively distribute forces applied to the tire track to reduce the amount of friction and deflection caused by each vehicle wheel as it passes. Tire track 70 comprising tire beams generally comprises elastically deformable material in the form of tube 120. Tube 120 forms chamber 125 for securing a medium such as pressurized air or absorptive material for absorbing force and/or sound. Tube 120 is secured to deck 26 by means of support frame 71, which contacts tube wall portion 123 for counteracting the forces of wheels 72A and 72B. Tube 120 secures top and side region tire beams 121 and 122, respectively, upon which wheels 72A and 72B ride. As shown in FIG. 3*d*, top and side region tire beams 121 and 122 may comprise separate beams comprising chambers 124 for securing force and sound absorbing materials. The separate beams each comprise foot portions 127 about which lip portions 126 of tube 120 are adapted to fit for purposes of securing the beams thereto. It should be appreciated that other appropriate means for fastening the top and side region tire beams to the tube are contemplated and are intended to be encompassed by the present disclosure. Alternatively, as shown in FIG. 3*e*, tube 120 may be adapted to secure integrated tire beam 128 comprising top and side region tire beams 121 and 122 which are coupled to one another to form a sheet-like beam. Integrated tire beam 128 comprises terminal ends 130 which are adapted to secure the integrated beam to the tube 120 about tube securing members 131.

Figure 4B:
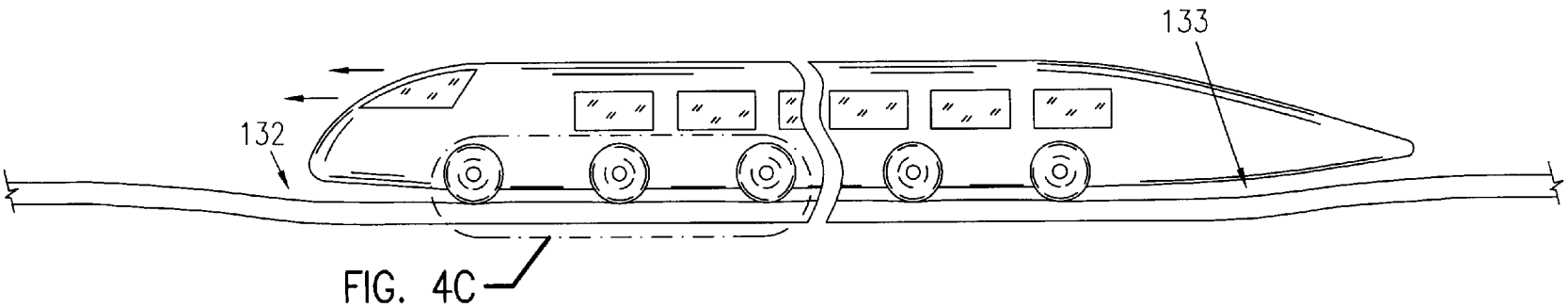
FIG. 4B illustrates displacement of a tire track assembly comprising a "tire beam" upon passage of a vehicle.
Figure 4C:
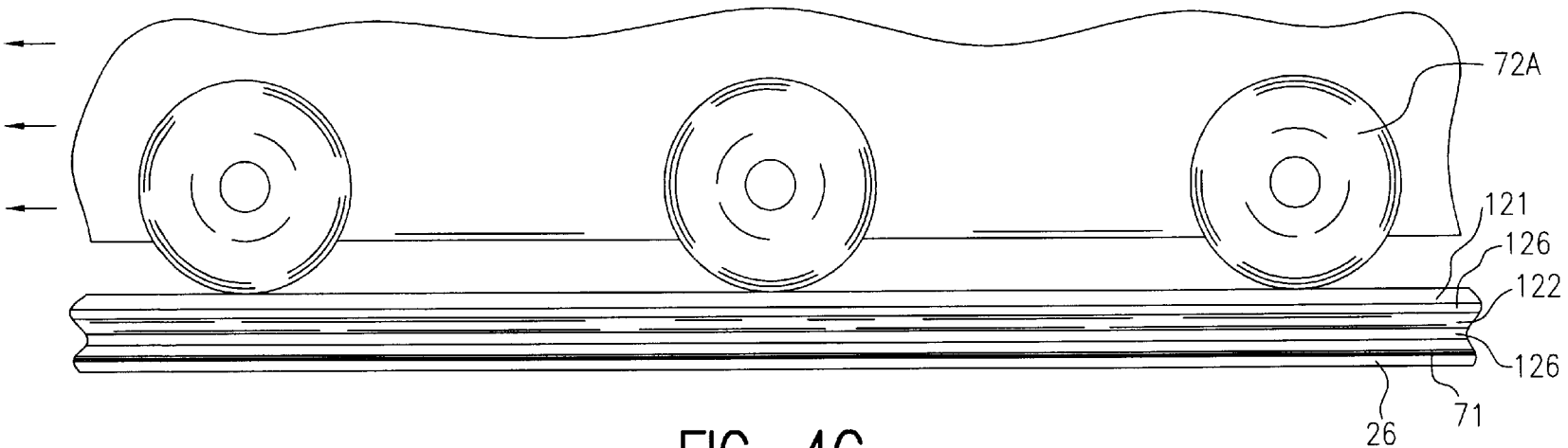
FIG. 4C is sectional view of the tire track assembly taken along line 4C—4C of FIG. 3D.

Top and side region tire beams for both separate and the integral tire beam configurations are generally rigid in nature and may be fabricated from steel or other suitable materials. Hence, as shown in FIG. 4*c*, because the tire beams are rigid, the forces applied to the tire beams by each passing wheel of a vehicle are not absorbed by that portion of the tire track directly proximate each passing wheel, but rather, are distributed along the entire length of a beam. Consequently, as shown in FIG. 4*b*, the forces applied to tire track may be distributed to locations in front 132, and behind 133, a passing vehicle such that the number of flexures of the tire track is one per vehicle passage as opposed to one per wheel passage, ultimately reducing the amount of friction, deflection and energy consumption caused by each vehicle wheel as it passes.

Figure 5:
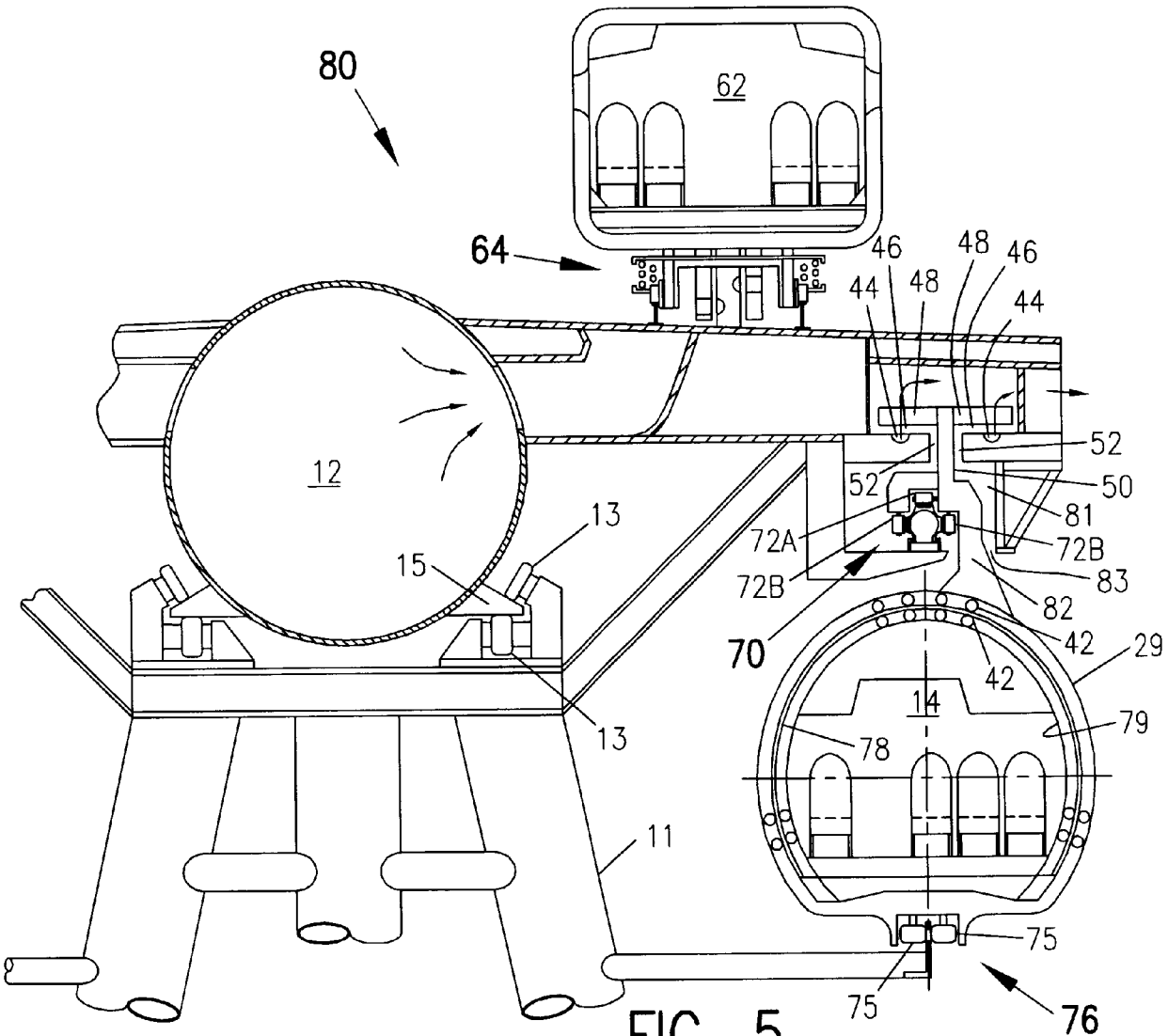
FIG. 5 is a lateral cross-sectional view of an all-weather guideway and vehicle formed in accordance with a third embodiment of the present invention.

FIG. 5 illustrates a third embodiment 80 designed to mitigate side sway of vehicle 14 from cross winds. The monorail guideway has a suspension/propulsion channel 81 having a slot opening 83 through an underside thereof. Suspension/propulsion channel 81 houses an upper tire track 70 as described in connection with FIG. 3, as well as a series of directionally uniform nozzles 44. A suspension/propulsion member 82 extends from the top of carriage 29 through slot opening 83, and includes wheels 72A, 72B for engaging tire track 70 and directionally biased vanes 48 for gathering the impulse from jets issuing from nozzles 44. An auxiliary stabilizing rail 76 is arranged to extend from support columns 11 to engage rollers 75 on the underside of carriage 29. As will be understood, stabilizing rail 76 helps to prevent side sway of vehicle 14. Of course, as an alternative, carriage 29 could be provided with a central fin along its underside for engagement by stationary rollers. In this embodiment, the vehicle carriage 29 includes a number of identical internal rings 78 spaced along the longitudinal axis of the vehicle which are integrated into the shell of a passenger compartment 79 so as to offer a smooth and continuous outer surface to the air flow. Roller wheels 42 permit the passenger compartment to rotate within the carriage rings 78, while the carriage 29 is restrained from lateral movement or rotation by upper tire track 70 and auxiliary guiding roller track 76. Both upper tire track 70 and stabilizing rail 76 are preferably narrow and are arranged along the centerline of vehicle 29 in order to minimize the "throw" of the switch and to give clearance for the vehicle to pass between upper and lower disconnected branches of guideway 12.

Figure 6:
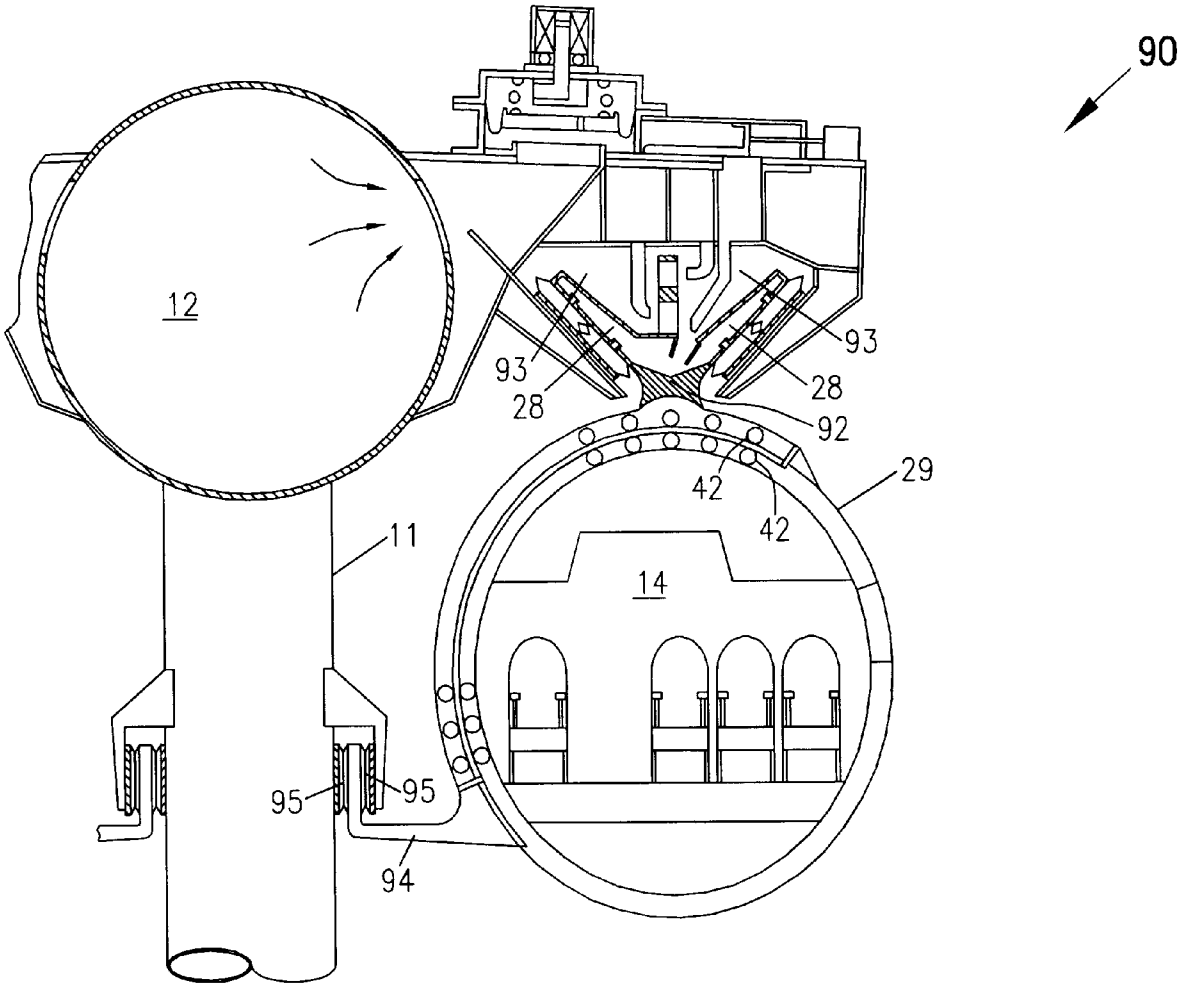
FIG. 6 is a lateral cross-sectional view of an all-weather guideway and vehicle formed in accordance with a fourth embodiment of the present invention.

A vehicle system 90 according to a fourth embodiment of the present invention is shown in FIG. 6. In this embodiment, Y-shaped suspension/propulsion members 28 are provided along the centerline 92 of carriage 29 and extend upwardly from carriage 29 for receipt within angular suspension/propulsion channels 93, and damper guides 95 mounted on support columns 11 receive a laterally extending member 94 of carriage 29 to prevent side sway.

Figure 7:
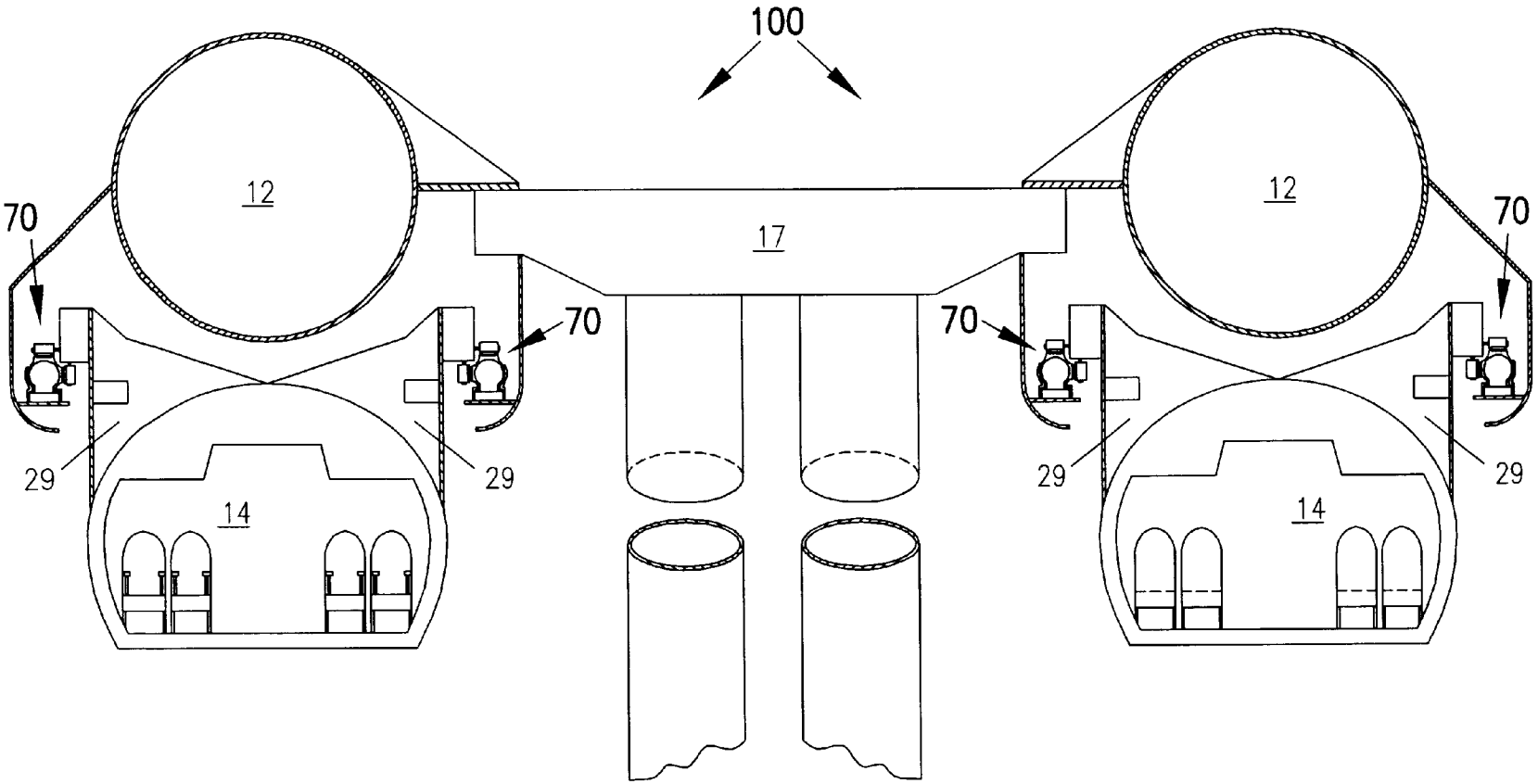
FIG. 7 is a sectioned perspective view of an all-weather guideway and vehicle formed in accordance with a fifth embodiment of the present invention.

A vehicle system 100 according to a fifth embodiment of the present invention is shown in FIG. 7. Vehicle system 100 is an aboveground system wherein the carriages 29 and vehicles 14 are suspended directly below an associated tubular guideway 12. The system shown includes parallel guideways 12 connected by a central support and supply structure 17. Each guideway 12 has a pair of parallel tire track rails 70 suspended therefrom for engagement by wheels of a carriage 29. The tubular guideways 12 and structure 17 help shield the carriages 29 and tire tracks 70 from freezing rain and snow.

Figure 8A:
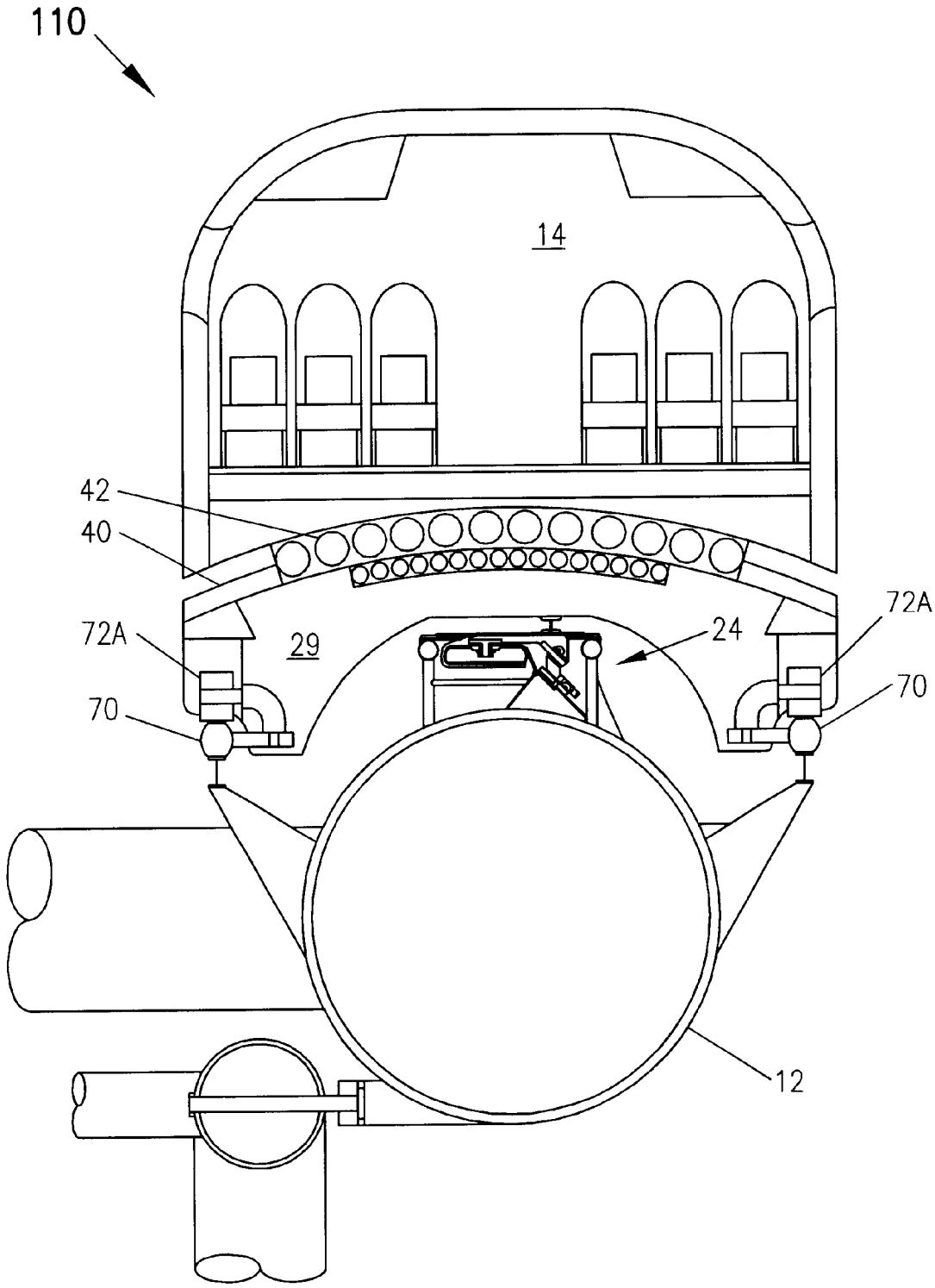
FIG. 8A is a lateral cross-sectional view of an all-weather guideway and vehicle formed in accordance with a sixth embodiment of the present invention, with the vehicle being shown is an upright orientation.
Figure 8B:
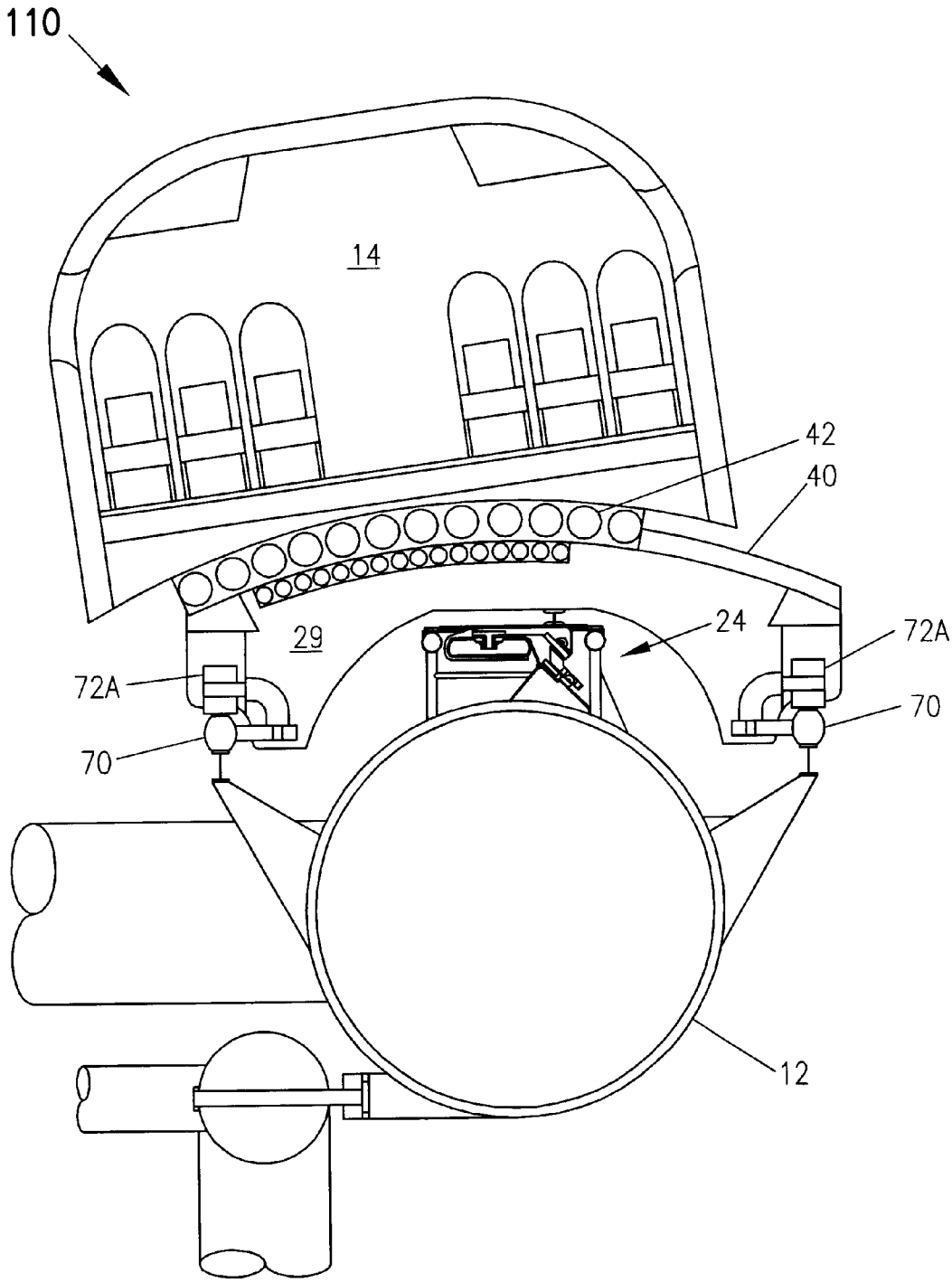
FIG. 8B is a lateral cross-sectional view of the all-weather guideway and vehicle shown in FIG. 8A, with the vehicle being shown is a tilted orientation.

FIGS. 8A and 8B show a vehicle system 110 according to a sixth embodiment of the present invention. Vehicle system 110 represents a currently preferred arrangement for a topside fair-weather vehicle mounted directly above tubular guideway 12, whereby additional loading on a cantilevered deck extending from the guideway to protect a suspended vehicle is avoided. Vehicle system 110 comprises vehicle 14 supported on carriage 29 for pivotal tilting motion useful in guideway turns. An arcuate flanged track 40 extends along an upper portion of carriage 29 for engagement by a plurality of upper and lower roller wheels 42 spring-mounted on vehicle 14 in an arcuate configuration corresponding to that of track 40. A more detailed description of the tilting mechanism is described and shown in U.S. Provisional Patent Application No. 60/308,085, entitled Arcuate Tilting Mechanism for High-Speed Trains, which application is incorporated herein by reference.

The guided vehicle systems of the fifth and sixth embodiments provide for suspension of the carriage directly below tubular guideway 12 and support of the carriage directly above the tubular guideway. Consequently, in these configurations, the efficiency of pressurized air transfer between tubular guideway 12 and propulsion means 24 is improved.

What is claimed is:

1. A guided vehicle system comprising:

a pair of continuous parallel suspension channels and a propulsion channel centrally located with respect to said pair of suspension channels, said suspension channels and said propulsion channel supported above the ground, said propulsion channel having a slot opening through an underside thereof;

reduced friction support means provided within each of said pair of suspension channels;

a plurality of nozzles arranged for issuing fluid jets primarily along a common longitudinal direction of said propulsion channel;

a carriage including a pair of suspension members received one within each of said pair of suspension channels for operative connection with said support means to suspend said carriage for travel along a length of said pair of suspension channels, and said carriage including a plurality of directionally biased impulse vanes received within said propulsion channel for cooperation with said nozzles, said impulse vanes being connected to said carriage by vertical members extending through said slot opening in said propulsion channel; and a vehicle carried by said carriage.

2. The guided vehicle system of claim 1, further comprising a plurality of arcuate roller tracks for suspending said vehicle from said carriage to allow said vehicle to rotate about an axis of rotation that is internal to said vehicle.

3. The guided vehicle system according to claim 1, wherein each of said pair of suspension channels has opposite inner surfaces inclined to converge toward a slot opening through a bottom of said suspension channel, each of said pair of suspension members is a Y-shaped member, and said support means lifts said Y-shaped member away from surface-to-surface engagement with said inner surfaces of said suspension channel.

4. The guided vehicle system according to claim 3, wherein said support means provides levitating cushions of pressurized air between said Y-shaped member and said inner surfaces of said suspension channel.

5. The guided vehicle system according to claim 1, wherein each of said pair of suspension channels has a track rail for engagement by at least one wheel provided on said suspension member.

6. The guided vehicle system according to claim 5, wherein said track rail includes an elastically deformable material and a plurality of strip springs extending along said track rail for engagement by said at least one wheel, said plurality of strip springs acting to spread out the load from said at least one wheel over said elastically deformable material.

7. The guided vehicle system according to claim 6, wherein said track rail includes a support frame and an arcuate portion of said elastically deformable material connected to said support frame to define an internal volume.

8. The guided vehicle system according to claim 7, wherein said internal volume is filled with pressurized fluid.

9. The guided vehicle system according to claim 7, wherein said arcuate portion of said track rail includes a top region along which said strip springs extend for engagement by a wheel rotating about a generally horizontal axis and a side region along which said strip springs extend for engagement by a wheel rotating about a generally vertical axis.

10. The guided vehicle system according to claim 9, wherein said support frame includes a counterbrace opposite said side region.

11. The guided vehicle system according to claim 5, wherein said track rail includes an elastically deformable material and a tire beam extending along said track rail for engagement by said at least one wheel, said tire beam acting to spread out the load from said at least one wheel over said elastically deformable material.

12. The guided vehicle system according to claim 11, wherein said elastically deformable material is adapted to define an internal volume.

13. The guided vehicle system according to claim 12, wherein said internal volume is filled with a sound-absorbing medium.

14. The guided vehicle system according to claim 11, wherein said tire beam is secured to an outer surface of said track rail.

15. The guided vehicle system according to claim 11, wherein each of said track rails includes a support frame including a counterbrace opposite said side region.

16. A guided vehicle system comprising:

a continuous suspension/propulsion channel, said suspension/propulsion channel having an opening through an underside thereof, said suspension/propulsion channel supported above the ground;

reduced friction support means provided within said suspension/propulsion channel and a plurality of nozzles arranged for issuing fluid jets primarily along a common longitudinal direction of said suspension/propulsion channel;

a carriage including a suspension/propulsion member extending through said opening for receipt within said suspension/propulsion channel for operative connection with said support means to suspend said carriage for travel along a length of said suspension/propulsion channel, said suspension/propulsion member having a plurality of directionally biased impulse vanes for cooperation with said nozzles, said impulse vanes being connected to said carriage by vertical members extending through said opening in said propulsion channel; and a vehicle carried by said carriage.

17. The guided vehicle system according to claim 16, further comprising a stabilizing rail beneath said carriage extending parallel to said suspension/propulsion channel, and at least one stabilizing roller for engaging said stabilizing rail to mitigate rotational sway of said carriage.

18. The guided vehicle system according to claim 17, wherein said stabilizing rail is stationary and said at least one stabilizing roller is a pair of opposing rollers fixed to an underside of said carriage for engaging opposite sides of said stabilizing rail.

19. The guided vehicle system according to claim 17, wherein said vehicle is mounted for rotation relative to said carriage about an axis of rotation that is internal to said vehicle.

20. The guided vehicle system according to claim 16, further comprising a damper guide extending parallel to said suspension/propulsion channel and alongside said carriage, and wherein said carriage includes at least one laterally extending member received by said damper guide to mitigate rotational sway of said carriage.

21. The guided vehicle system according to claim 20, wherein said vehicle is mounted for rotation relative to said carriage about an axis of rotation that is internal to said vehicle.

22. The guided vehicle system of claim 16 wherein said reduced friction support means is selected from the group consisting of pressurized air and at least one track rail.

23. The guided vehicle system of claim 22 wherein said track rail is selected from the group consisting of tire tracks, tire beams, and metal.

24. A guided vehicle system comprising:

a tubular guideway supported above the ground, said guideway containing pressurized air;

a deck extending laterally from said guideway along a length of said guideway;

a first carriage supported by said deck, said first carriage including a plurality of directionally biased impulse vanes;

a first plurality of nozzles for issuing air jets primarily along a common guideway direction, said first plurality of nozzles communicating with said guideway to receive said pressurized air and being arranged to cooperate with said impulse vanes of said first carriage to propel said first carriage;

a first passenger vehicle carried by said first carriage.

25. The guided vehicle system according to claim 24, further comprising:

a second carriage supported by said deck, said second carriage including a plurality of directionally biased impulse vanes;

a second plurality of nozzles for issuing air jets primarily along a common guideway direction, said second plurality of nozzles communicating with said guideway to receive said pressurized air and being arranged to cooperate with said impulse vanes of said second carriage to propel said second carriage; and a second passenger vehicle carried by said second carriage.

26. A guided vehicle system comprising:

a tubular guideway supported above the ground, said guideway containing pressurized air;

a pair of track rails supported by said tubular guideway and parallel thereto;

a carriage having multiple wheels engaging said pair of track rails for guided travel along said pair of track rails, said carriage further having a transversely extending arcuate roller track and a plurality of directionally biased impulse vanes;

a plurality of nozzles for issuing air jets primarily along a common guideway direction, said plurality of nozzles communicating with said tubular guideway to receive said pressurized air and being arranged to cooperate with said impulse vanes of said carriage to propel said carriage; and a vehicle connected to said carriage for travel with said carriage, said vehicle having a plurality of rollers in an arcuate configuration corresponding to said roller track of said carriage.

27. The guided vehicle system according to claim 26, wherein each of said pair of track rails comprises an elastically deformable material and a plurality of strip springs extending along said track rail for engagement by said plurality of wheels, said plurality of strip springs acting to spread out the load from at least one wheel of said plurality of wheels over said elastically deformable material.

28. The guided vehicle system according to claim 27, wherein each of said track rails includes a support frame and an arcuate portion of said elastically deformable material connected to said support frame to define an internal volume.

29. The guided vehicle system according to claim 28, wherein said internal volume is filled with pressurized fluid.

30. The guided vehicle system according to claim 28, wherein said arcuate portion of each said track rail includes a top region along which said strip springs extend for engagement by wheels of said carriage rotating about a generally horizontal axis and a side region along which said strip springs extend for engagement by wheels of said carriage rotating about a generally vertical axis.

31. The guided vehicle system according to claim 30, wherein said support frame includes a counterbrace opposite said side region.

32. The guided vehicle system according to claim 26, wherein each of said pair of track rails comprises an elastically deformable material and a tire beam extending along said track rail for engagement by said plurality of wheels, said tire beam acting to spread out the load from at least one wheel of said plurality of wheels over said elastically deformable material.

33. The guided vehicle system according to claim 32, wherein said tire beam is secured to an outer surface of said track rail.

34. The guided vehicle system according to claim 32, wherein said elastically deformable material is adapted to define an internal volume.

35. The guided vehicle system according to claim 34, wherein said internal volume is filled with a sound-absorbing medium.

36. The guided vehicle system according to claim 32, wherein each of said track rails includes a support frame including a counterbrace opposite said side region.

37. A track rail for a vehicle comprising:

an elastically deformable material defining an internal volume for securing an absorptive medium;

an absorptive medium;

a support frame adapted to secure said track rail to a surface;

means for distributing forces applied to said track rail by a wheels of a passing vehicle; said means selected from the group consisting of strip springs and tire beams.

38. The track rail of claim 37 wherein said support frame includes a counterbrace opposite a side region of said track rail.

* * * * *